US009755357B1

(12) United States Patent
Kim et al.

(10) Patent No.: US 9,755,357 B1
(45) Date of Patent: Sep. 5, 2017

(54) MODULE ASSEMBLY

(71) Applicant: LUXROBO, Seoul (KR)

(72) Inventors: Seok Jung Kim, Incheon (KR); Yoon Son, Seoul (KR); Sang Hun Oh, Seoul (KR)

(73) Assignee: Luxrobo, Seoul (KR)

( * ) Notice: Subject to any disclaimer, the term of this patent is extended or adjusted under 35 U.S.C. 154(b) by 0 days.

(21) Appl. No.: 15/287,924

(22) Filed: Oct. 7, 2016

Related U.S. Application Data

(63) Continuation of application No. 15/146,340, filed on May 4, 2016.

(30) Foreign Application Priority Data

Mar. 7, 2016 (KR) ..... 10-2016-0027233

(51) Int. Cl.

| | |
|---|---|
| ***H01R 11/30*** | (2006.01) |
| ***H01R 13/60*** | (2006.01) |
| ***H01R 13/62*** | (2006.01) |
| ***H01R 13/04*** | (2006.01) |
| ***H01R 43/26*** | (2006.01) |

(52) U.S. Cl.
CPC ..... *H01R 13/6205* (2013.01); *H01R 13/04* (2013.01); *H01R 43/26* (2013.01)

(58) Field of Classification Search
CPC ..... H01R 11/30; H01R 13/6205
USPC ..... 439/38, 39, 40
See application file for complete search history.

(56) References Cited

U.S. PATENT DOCUMENTS

| | | | | |
|---|---|---|---|---|
| 5,382,167 | A * | 1/1995 | Janson, Jr. | E05C 19/165 439/38 |
| 5,921,783 | A | 7/1999 | Fritsch et al. | |
| 8,672,228 | B1 | 3/2014 | Saini | |
| 2010/0197148 | A1* | 8/2010 | Rudisill | H01R 11/30 439/40 |
| 2011/0263177 | A1* | 10/2011 | Lemchen | A63H 33/04 446/87 |

(Continued)

FOREIGN PATENT DOCUMENTS

| | | | |
|---|---|---|---|
| CN | 103394200 | A | 11/2013 |
| JP | 11128547 | A | 5/1999 |

(Continued)

OTHER PUBLICATIONS

Non-Final Office Action dated Jul. 12, 2016 for U.S. Appl. No. 15/146,340, filed May 4, 2016.

*Primary Examiner* — Abdullah Riyami
*Assistant Examiner* — Thang Nguyen
(74) *Attorney, Agent, or Firm* — Dinsmore & Shohl LLP; Youngsok Choi

(57) ABSTRACT

Provided is a module assembly including a plurality of modules. The modules each include a polyhedral housing with a polygonal plane, a pin provided on one side of a corner of the housing to selectively protrude, a pin installation portion in which the pin is installed to be movable, a pin receiver provided on another side of the corner of the housing such that a pin of another module is to be inserted thereinto, and a magnet installed between the pin installation portion and the pin receiver, and configured to apply magnetic force to both the pin provided in the pin installation portion and the pin of the other module to be received in the pin receiver.

19 Claims, 9 Drawing Sheets

(56) References Cited

U.S. PATENT DOCUMENTS

| | | | | |
|---|---|---|---|---|
| 2013/0343025 | A1* | 12/2013 | Bdeir | H01R 13/6205 361/803 |
| 2015/0251104 | A1 | 9/2015 | Lange et al. | |
| 2016/0006187 | A1* | 1/2016 | Kim | H01H 1/58 439/39 |
| 2016/0093975 | A1 | 3/2016 | Katiyar et al. | |
| 2016/0181728 | A1 | 6/2016 | Hashiguchi | |
| 2016/0190732 | A1 | 6/2016 | Gao et al. | |
| 2016/0190734 | A1* | 6/2016 | Rohrbach | H01R 13/6205 439/39 |
| 2016/0190736 | A1 | 6/2016 | Chun et al. | |

FOREIGN PATENT DOCUMENTS

| | | | |
|---|---|---|---|
| KR | 100349220 | B1 | 1/2003 |
| KR | 20110087603 | A | 8/2011 |
| KR | 20150031733 | A | 3/2015 |
| KR | 20150054886 | A | 5/2015 |
| WO | 2012/035567 | A1 | 3/2012 |

* cited by examiner

MODULE ASSEMBLY

CROSS-REFERENCE TO RELATED APPLICATION(S)

This application is a continuation of U.S. patent application Ser. No. 15/146,340, which claims priority to Korean Patent Application No. 10-2016-0027233 filed on Mar. 7, 2016, in the Korean Intellectual Property Office, the entire contents of which are hereby incorporated by reference.

BACKGROUND

1. Field

One or more example embodiments relate to a module assembly.

2. Description of Related Art

Recently, various module-based designing tools have been suggested for the purpose of education, hobbies, research, and manufacture. Modules included in such designing tools may each perform a predetermined function, and be connected to another to form a module assembly. The modules may be electrically connected to one another to exchange energy, signals, or data. A user may design a module assembly to achieve a predetermined purpose by assembling modules according to a provided manual or in a creative manner.

Such modules are provided in the form of blocks having predetermined three-dimensional shapes, in general, the shapes of rectangular parallelepipeds or regular hexahedra. Connecting structures for maintaining coupling between the modules and transferring electrical signals are being adopted.

In an example, US2013/0343025 A1 discloses modules coupled to each other using a male protrusion and a female indentation to be coupled to each other, magnets to maintain engagement therebetween, and spring probes configured to transfer current.

In another example, US2015/0251104 A1 discloses modules coupled to each other using a male protruding coupling plug and a female coupling recess to be coupled to each other, a male annular protruding bar having protrusions and a female annular groove having undercuts, the annular protruding bar and the annular groove to be coupled to each other, and plug contacts and slip ring contacts for electrical contact.

The aforementioned related arts have issues as follows.

First, a member protruding from one of the modules is provided to couple the modules. The protruding member is exposed to an outside at all times, and thus may be easily damaged by external impact.

Further, a direction in which the modules are coupled to each other is restricted to a direction in which the protruding member of the one module fits in a recess of another module. Thus, the modules necessarily need to be coupled to each other in a predetermined order. If coupled in an incorrect order, the modules need to be reassembled.

Further, a user may experience inconvenience in that a process of arranging the protruding member in the recess is to be performed in advance to precisely couple the modules.

In addition, magnets configured to maintain coupling between the modules are exposed outside the module, and thus may come out or be damaged.

SUMMARY

An aspect provides a module assembly that may prevent damage to pins used to couple modules to each other.

Another aspect also provides a module assembly that may enable modules to be assembled at regular positions without performing a separate arrangement.

Still another aspect also provides a module assembly that may prevent damage to magnets configured to maintain coupling between modules.

Yet another aspect also provides a module assembly that may enable modules to be assembled irrespective of a coupling order.

According to an aspect, there is provided a module assembly including a plurality of modules. The modules may each include a polyhedral housing with a polygonal plane, a pin provided on one side of a corner of the housing to selectively protrude, a pin installation portion in which the pin is installed to be movable, a pin receiver provided on another side of the corner of the housing such that a pin of another module is to be inserted thereinto, and a magnet installed between the pin installation portion and the pin receiver, and configured to apply magnetic force to both the pin provided in the pin installation portion and the pin of the other module to be received in the pin receiver.

The pin installation portion and the pin receiver may be formed on both sides of each corner of the housing.

The housing may have a regular polygonal plane.

A distance from the corner to the pin may correspond to a distance from the corner to the pin receiver.

A terminal may be provided on a side of the housing to exchange at least one of electrical energy, electric signals, and data with another module.

The plurality of modules may include a first module and a second module, the pin adjacent to a first magnet of the first module may be inserted into the pin receiver adjacent to a second magnet of the second module, and the magnet of the first module may be disposed such that a distance D1 from the first magnet to the pin when the pin of the first module is received in the pin installation portion is to be greater than a sum of a distance D2 from the second magnet to a side of the second module and a distance D3 from a side of the first module to the pin.

The pin may include a head and a projection protruding from the head, and the pin installation portion may include a head guide configured to provide a space in which the head is movable and to guide a movement of the head, a projection guide configured to provide a space in which the projection is movable and to guide a movement of the projection, and a stopper provided between the head guide and the projection guide to prevent the head from being separated toward an outside of the housing.

According to another aspect, there is also provided a module assembly including a plurality of modules each having a first state in which a pin is protruding from each of the modules and a second state in which the pin is received in each of the modules, the modules each including a pin receiver into which the pin is to be inserted, and a plate to which the modules are to be coupled. A first module and a second module among the modules may be surface-to-surface coupled to each other, the pin of the first module may switch from the second state to the first state to be inserted into the pin receiver of the second module when the first module is surface-to-surface coupled to the second module, and the pin may switch from the first state to the second state when the surface-to-surface coupling between the first module and the second module is cancelled.

The module assembly may further include a pin operator provided in the first module and the second module to selectively move the pin.

The pin operator may include a first magnet and a second magnet provided at corners of the first module and the second module to be surface-to-surface coupled to each other, and configured to attract the pin toward the first magnet and the second magnet, respectively.

The plate may include a protrusion, and the first module and the second module may each include a fit-coupling portion in which the protrusion is to fit.

The fit-coupling portion may include an insertion recess into which the protrusion is to be inserted, and at least one of a bolt fastening hole and a magnet.

The pin may be configured to protrude in a direction perpendicular to a direction in which the first module and the second module fit on the plate.

According to another aspect, there is also provided a module assembly including a first module and a second module disposed to be spaced apart from each other, and a third module to be coupled to the first module and the second module while being in surface contact therewith. The third module may be coupled to the first module when a pin provided in one of the first module and the third module to selectively protrude fits in a pin receiver provided in the other of the first module and the third module, the third module may be coupled to the second module when a pin provided in one of the second module and the third module to selectively protrude fits in a pin receiver provided in the other of the second module and the third module, and the pins may be configured to protrude when the third module fits in between the first module and the second module.

The pins may be configured to be received in the modules in which the pins are provided when the third module does not fit in between the first module and the second module.

The first module, the second module, and the third module may each have a side to be in surface contact with an adjacent module and a regular polygonal plane.

The pin of each of the first module and the second module may be provided on one side with a corner on the plane as the center, and the pin receiver of each of the first module and the second module may be provided on another side with the corner on the plane as the center.

The first module, the second module, and the third module may be coupled to each other in an "I"-shaped or "L"-shaped form.

The module assembly may further include a fourth module to be coupled to the third module. The fourth module may be coupled to the third module when a pin provided in one of the third module and the fourth module to selectively protrude fits in a pin receiver provided in the other of the third module and the fourth module, and the pin may be configured to protrude when the fourth module is in surface contact with the third module.

The module assembly may further include a plate to which the first module, the second module, and the third module are to be coupled. The first module and the second module may be coupled to the plate in advance, and the third module may be coupled to the plate by fitting in a space between the first module and the second module.

Additional aspects of example embodiments will be set forth in part in the description which follows and, in part, will be apparent from the description, or may be learned by practice of the disclosure.

According to an example embodiment, a module assembly may prevent damage to pins used to couple modules to each other. Further, modules may be assembled at regular positions without performing a separate arrangement. In addition, damage to magnets configured to maintain coupling between modules may be prevented. Moreover, modules may be assembled irrespective of a coupling order.

BRIEF DESCRIPTION OF THE DRAWINGS

These and/or other aspects, features, and advantages of the disclosure will become apparent and more readily appreciated from the following description of example embodiments, taken in conjunction with the accompanying drawings of which.

DETAILED DESCRIPTION

Hereinafter, some example embodiments will be described in detail with reference to the accompanying drawings.

When it is determined detailed description related to a related known function or configuration which may make the purpose of the present disclosure unnecessarily ambiguous in describing the present disclosure, the detailed description will be omitted here.

Further, the ordinal terms such as first, second, and the like may be used herein to describe equal and independent elements, and thus should not be construed as indicating "main/sub" or "master/slave" by that order.

Figure 1:
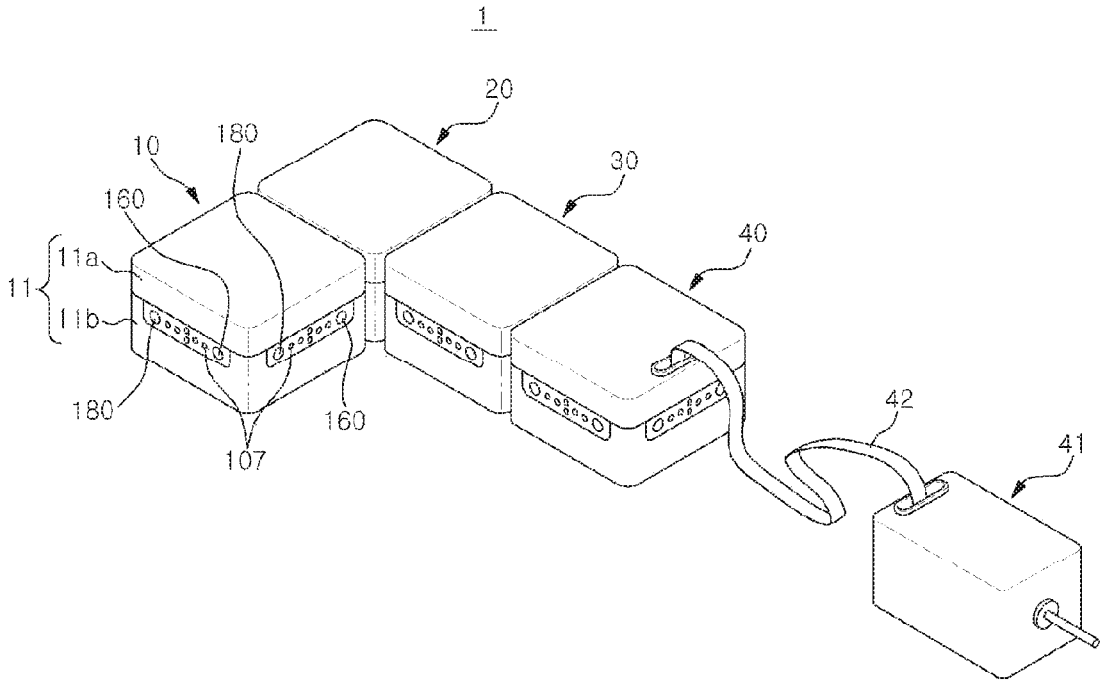
FIG. 1 is a perspective view illustrating a module assembly assembled according to an example embodiment.
Figure 2:
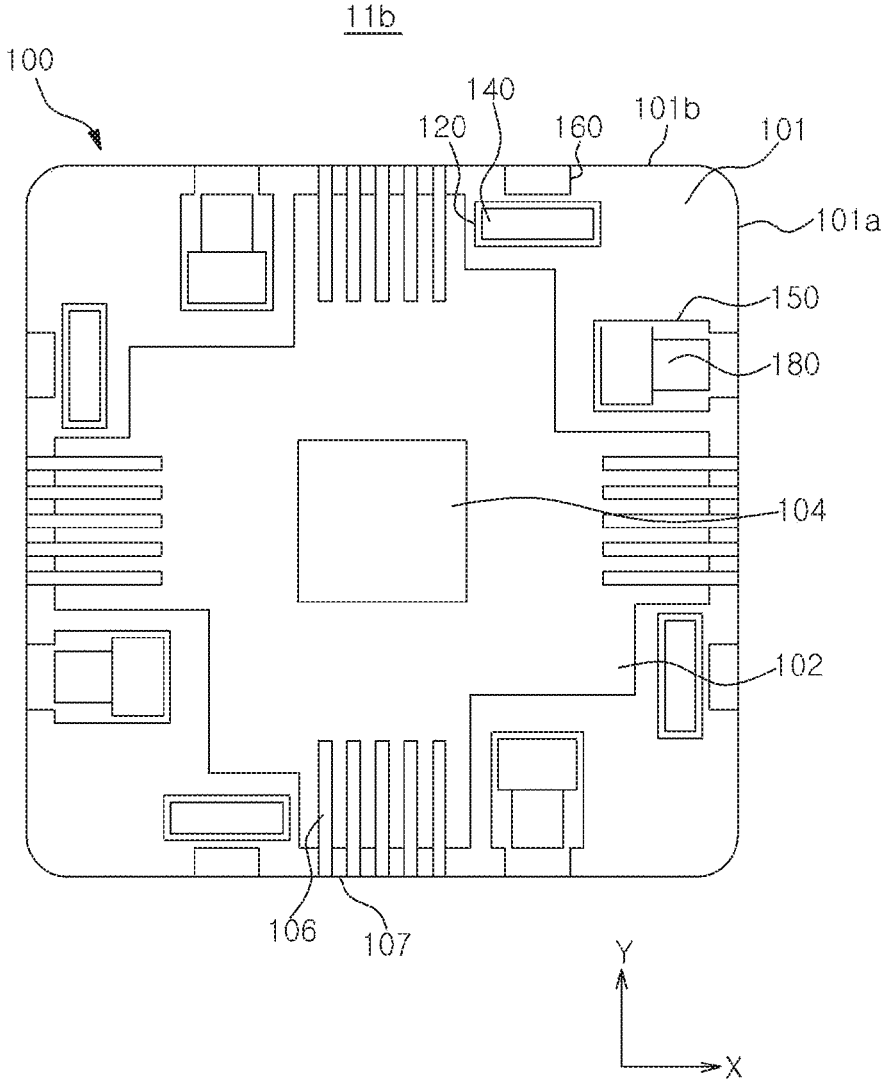
FIG. 2 is a top view illustrating an inner structure of a first module of FIG. 1.
Figure 3:
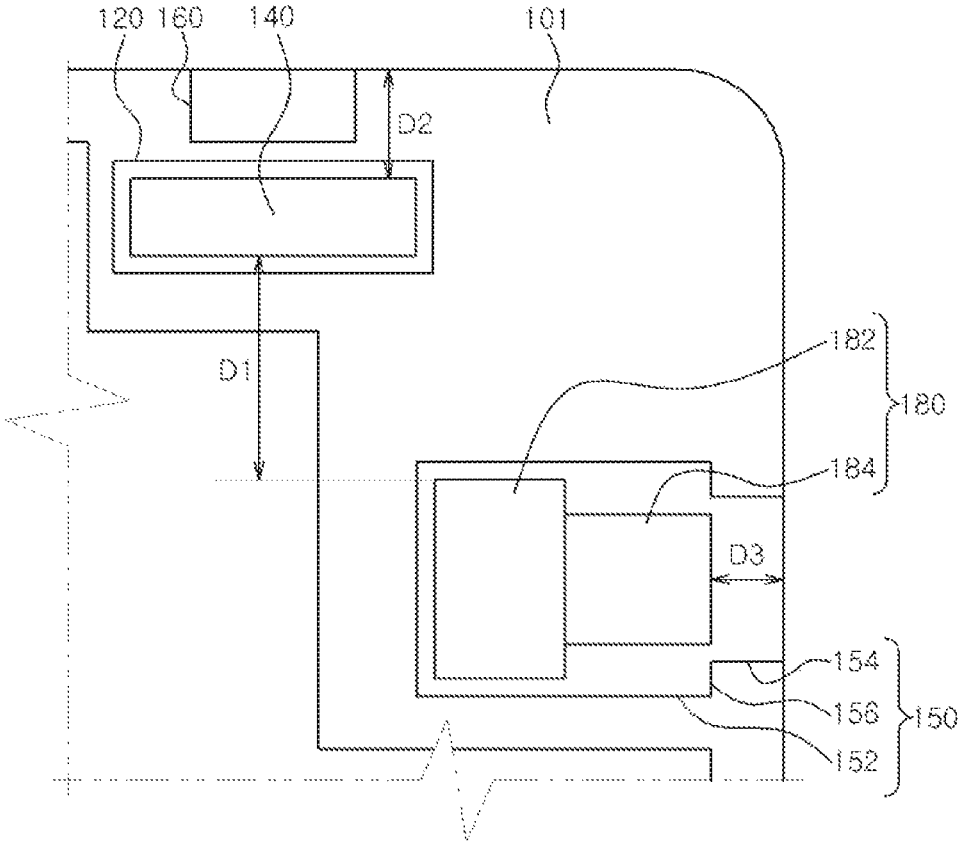
FIG. 3 is an enlarged view illustrating a corner of the first module of FIG. 2.

FIG. 1 is a perspective view illustrating a module assembly assembled according to an example embodiment, FIG. 2 is a top view illustrating an inner structure of a first module of FIG. 1, and FIG. 3 is an enlarged view illustrating a corner of the first module of FIG. 2.

Referring to FIGS. 1 and 3, a module assembly 1 according to an example embodiment includes a plurality of modules 10, 20, 30 and 40 to be assembled.

In the example embodiment, the module assembly 1 may be defined as a set of one or more modules 10, 20, 30, and 40 to be assembled or a structure in which the one or more modules 10, 20, 30, and 40 are assembled. However, the purpose, type, form, and number of the modules are not limited thereto. For example, the module assembly 1 may be a part of an educational kit which helps a student or a user to understand an operating principle of an electronic device while assembling the modules 10, 20, 30, and 40. In another example, the module assembly 1 may be a part of a research kit to be used by a researcher to design a device to perform a predetermined purpose. In still another example, the module assembly 1 may be a part of a toy kit to be assembled by a user as a hobby.

In the example embodiment, an example in which the module assembly 1 includes four modules 10, 20, 30, and 40, as shown in FIG. 1, is described. The four modules 10, 20, 30, and 40 may also be referred to as a first module 10, a second module 20, a third module 30, and a fourth module 40, respectively.

In addition, in the example embodiment, the modules 10, 20, 30, and 40 may each be defined as an object configured to exchange electric signals with another module or an external device. The modules 10, 20, 30, and 40 may each include a central processing unit (CPU), a memory, and a power source to operate independently, or may include a sensing device, a processing device, and a driving device to operate by being controlled by another module. Further, the modules 10, 20, 30, and 40 may each be configured to perform a predetermined function independently or by interacting with another module. In a case in which the modules 10, 20, 30, and 40 each include a CPU, firmware may be installed for each module.

For example, in the example embodiment, the first module 10 may be an infrared sensor module configured to receive infrared signals from a remote control. The second module 20 may be a wireless communication module configured to perform wireless communication with a smartphone. The third module 30 may be a gyro sensor module configured to sense a position. The fourth module 40 may be a driving module configured to operate a driving device such as a motor 41. Here, the fourth module 40 may be connected to the driving device via a cable 42. In this example, the module assembly 1 may be a device configured to selectively operate the motor 41 by receiving a signal from a remote control or a smartphone. The foregoing configuration of the module assembly 1 is merely an example. Each module may be provided to perform a predetermined function independently or by interoperating with another module.

The modules 10, 20, 30, and 40 may each be a three-dimensional structure with a circular or polygonal plane having a plurality of sides to be in surface contact with another module. Here, the surface contact may be construed as indicating not only that the whole areas of sides are in contact, but also that sides are partially in contact such that a side of one module is partially in contact with a side of another module while facing each other.

In the example embodiment, an example in which the modules 10, 20, 30, and 40 have regular quadrilateral planes of the same size is illustrated. In detail, the modules 10, 20, 30, and 40 each have four sides. In addition, in the example embodiment, an example in which the modules 10, 20, 30, and 40 are the same in heights, and thus the modules 10, 20, 30, and 40 are rectangular parallelepipeds of the same size is described.

In another example embodiment, the modules 10, 20, 30, and 40 may be formed to have polygonal planes such as equilateral triangular planes, rectangular planes, or regular pentagonal planes, and more particularly, to have regular polygonal planes. A portion of the modules 10, 20, 30, and 40 may have different three-dimensional shapes. Further, a portion of the modules 10, 20, 30, and 40 may have three-dimensional shapes such as pyramidal or prismatic shapes.

Here, the first module 10 may include a housing 11 which forms an appearance of the first module 10, a terminal 107 exposed on a side of the housing 11 and configured to transfer or receive electric signals to or from another module being connected thereto, a pin installation portion 150 in which a pin 180 configured to selectively protrude externally from the housing 11 is provided, and a pin receiver 160 into which a pin of the other module is to be inserted.

In the example embodiment, the housing 11 is a case formed in the shape of a rectangular parallelepiped with a regular quadrilateral plane, and configured to protect internal components. In an example, as shown in FIG. 1, the housing 11 may be provided in the form in which an upper case 11*a* and a lower case 11*b* are coupled. The housing 11 may be configured by forming the upper case 11*a* and the lower case 11*b* as an integral body, as necessary. In another example, the housing 11 may be divided into a larger number of parts and assembled, or divided in another direction and assembled.

The terminal 107 may transfer or receive electric signals to or from another module being connected thereto. In an example, the terminal 107 may receive electric signals from a substrate 102 provided in the housing 11 and transfer the electric signals to a terminal of the other module being in contact with the terminal 107. The terminal 107 may have a plurality of contact points or connecting pins. The form of the terminal 107 may vary depending on methods of transferring electric signals or standardized standards. The terminal 107 may be disposed on one side of the housing 11 while forming a set with the pin 180, the pin installation portion 150, and the pin receiver 160. In detail, the terminal 107 may be disposed between the pin 180 and the pin receiver 160 to be in contact with a terminal disposed between a pin and a pin receiver of another module.

In the example embodiment, an example in which the terminal 107 is provided on each side of the housing 11 is described. However, in some example embodiments, there may be a side on which the terminal 107 is not formed.

Referring to FIG. 2, the lower case 11*b* may include a frame 100 which forms an appearance and an inner structure of the first module 10, the substrate 102 provided in the frame 100, and a processor 104 installed on the substrate 102.

The frame 100 may be a structure which forms a portion or the whole of the housing 11. The frame 100 may form an appearance of a portion or the whole of the housing 11, and provide a structure and a space to install a variety of components therein. In the example embodiment, an example in which the frame 100 forms the lower case 11*b* of the housing 11 is described. However, the scope of example embodiments is not limited thereto. In addition, in the example embodiment, the frame 100 may be provided in a rectangular shape and have four corners 101.

Electronic components (not shown) to implement a function of the first module 10 may be mounted on the substrate 102. The substrate 102 may be fastened at a center of an inner space of the frame 100. As described above, in a case in which the first module 10 is an infrared sensor module, an infrared sensor may be provided on one side of the housing 11, and the substrate 102 may be electrically connected to the infrared sensor.

The processor 104 may be provided to control the first module 10 in a case in which the first module 10 is driven by independent firmware. The processor 104 may be omitted depending on a function or a characteristic of the first module 10. As described above, in a case in which the first module 10 is an infrared sensor module, the processor 104 may process a value sensed by the infrared sensor and transfer a resulting value to another module.

Meanwhile, the terminal 107, the pin 180, the pin installation portion 150, and the pin receiver 160 may be provided on a side of the frame 100. A magnet 140 may be provided between the pin installation portion 150 and the pin receiver 160.

In detail, the terminal 107 may function as a path to exchange electric signals with another module, and may correspond to an end portion of a conducting wire 106 which extends from the substrate 102. Here, the terminal 107 may be a metallic plate or a spring probe which is elastically movable and displaceable to some extent, and the conducting wire 106 may be connected thereto. The terminal 107 may transfer electric signals provided from the substrate 102 to another module, or receive electric signals from another module and transfer the electric signals to the substrate 102. In an example, the terminal 107 may be configured to transfer electric signals directly to a terminal 107 disposed on another side.

In the example embodiment, an example in which terminals 107 are formed at centers of four sides of the frame 100 will be described. In this example, terminals are formed at centers of sides of all modules, and thus the modules may be easily assembled. Further, an example in which a plurality of terminals 107 and conducting wires 106 are provided on sides of the frame 100 is illustrated. However, the number of the terminals 107 and the number of the conducting wires 106 may vary as necessary.

The pin 180 and the pin receiver 160 may be installed separately on both sides with the corner 101 of the frame 100 as the center. In detail, the corner 101 may be defined as an area in which a first edge 101*a* of the frame 100 is connected to a second edge 101*b* of the frame 100. With the corner 101 as the center, the pin 180 and the pin installation portion 150 may be provided on one side, and the pin receiver 160 may be disposed on the other side.

Further, the pin 180 and the pin receiver 160 may be disposed with each corner 101 of the rectangular frame 100 as the center. In this example, the pin 180 and the pin receiver 160 may be disposed with each corner 101 as the center in the same direction. For example, in a case in which the pin receiver 160 is formed on the left side of a corner 101, pin receivers may be formed on the left sides of the other corners.

Here, to easily couple modules, a distance between the pin 180 and the corner 101 may correspond to a distance between the pin receiver 160 and the corner 101.

The pin 180 may be a magnetic material, and may include a head 182 and a projection 184 protruding from the head 182. In an example, the pin 180 may be metal including an iron (Fe) component. The head 182 may have a cross-sectional area larger than that of the projection 184. In an example, the pin 180 may be "T"-shaped. In this example, a portion of the head 185 may be obstructed by a stopper 156 of the pin installation portion 150. Thus, when the pin 180 is attracted toward an adjacent module by magnetic force, the entire first module 10 may be moved, whereby the modules may be automatically coupled to each other.

The pin 180 may be installed in the pin installation portion 150 to be movable in an outward direction or an inward direction of the housing 11. In detail, the first module 10 may have a first state in which the pin 180 is protruding from the first module 10, and a second state in which the pin 180 is received in the first module 10. To achieve the foregoing, the pin installation portion 150 may include a head guide 152 configured to provide a space in which the head 182 of the pin 180 is movable and to guide a movement of the head 182, a projection guide 154 configured to provide a space in which the projection 184 of the pin 180 is movable and to guide a movement of the projection 184, and the stopper 156 provided between the head guide 152 and the projection guide 154 to prevent the head 182 from being separated toward an outside of the frame 100. In the example embodiment, an example in which the pin installation portion 150 includes the head guide 152 and the projection guide 154 is described. However, the configuration of the pin installation portion 150 may vary depending on the shape of the pin 180.

The head guide 152 and the projection guide 154 may be formed in shapes and sizes corresponding to cross-sectional areas of the head 182 and the projection 184 such that the pin 180 may slide stably. One side of the projection guide 154 may be opened toward the outside of the frame 100 such that the projection 184 may protrude toward the outside of the frame 100 as the pin 180 moves. In the example embodiment, an example in which the pin installation portion 150 is configured such that the pin 180 may protrude in a direction perpendicular to a side of the frame 100 is illustrated. However, the pin installation portion 150 may be configured such that the protruding direction of the pin 180 and the side of the frame 100 may form a predetermined angle.

The pin receiver 160 may provide a space to receive a pin protruding from another module, and be formed in the shape of a recess having a width and a depth corresponding to those of a projection of the pin protruding toward an outside of the other module.

Meanwhile, the magnet 140 may be provided in a space between the pin installation portion 150 and the pin receiver 160 of the corner 101. The magnet 140 may be disposed such that magnetic force may be applied simultaneously to the pin 180 provided in the pin installation portion 150 and a pin of another module coupled to the first module 10 through the pin receiver 160.

First, the magnet 140 may apply magnetic force to the pin 180 when the pin 180 is completely received in the pin installation portion 150, and also when the pin 180 is completely protruding. In detail, the pin 180 is positioned within a range of the magnetic force of the magnet 140 at all times. Here, a distance between the magnet 140 and the pin 180 in a state in which the pin 180 is completely received in the pin installation portion 150 may be denoted as D1. In the drawing, D1 is expressed as a distance between the magnet 140 and an end portion of the head 182 of the pin 180 for ease of description. However, in practice, D1 should be construed as a distance to be used to calculate a magnitude of magnetic force applied between the magnet 140 and the pin 180. Hereinafter, a distance between a magnet and a target object may be the same as is described above.

When the magnetic force of the magnet 140 is applied to the pin 180, the pin 180 may be magnetized. For example, in a case in which a side of the magnet 140 faces the pin 180 and the side corresponds to north pole (N-pole), the head 182 may be magnetized as south pole (S-pole) and an end portion of the projection 184 may be magnetized as N-pole. Thus, the pin 180 may function as a magnet. When magnetic force of a magnet provided in another module is not applied, the pin 180 may be attracted toward the magnet 140 and received in the housing 11. When stronger magnetic force of the magnet provided in the other module is applied, the pin 180 may protrude toward the outside of the housing 11.

Further, the magnet 140 needs to apply magnetic force to a pin of another module to be coupled. In detail, a magnitude of magnetic force applied by the magnet 140 to a pin of another module may change based on a distance D2 from the magnet 140 to a side of the frame 100, a distance D3 from a side of the other module to an end portion of the pin, and a distance D4 between the modules. Substantially, the distances D2 and D3 are preset, and thus the magnitude of the magnetic force applied by the magnet 140 to the pin of the other module may change as the distance D4 increases or decreases. Here, in a case in which the modules are formed in the same shapes, the distance D3 may correspond to a distance from a side of the first module 10 to an end portion of the pin 180. A relationship among the distances D1, D2, D3, and D4 will be described in detail later.

The magnet 140 may apply magnetic force to a pin of another module, thereby attracting the pin of the other module into the pin receiver 160. In detail, the magnet 140 may maintain the pin of the other module to be in the first state. To achieve the foregoing, the magnet 140 may be provided to have magnetism to apply stronger magnetic force to the pin of the other module than a magnet of the other module may do when the pin of the other module is within a set distance, hereinafter, a "valid distance", from the magnet 140.

Here, the magnet 140 may be formed such that a polarity opposite to a polarity of a magnetized projection of a pin of another module may be disposed toward the pin receiver 160. For example, in a case in which an end portion of the projection of the pin of the other module is magnetized as N-pole, S-pole of the magnet 140 may be disposed toward the pin receiver 160. In a case in which modules are formed in the same shapes as described in the example embodiment, the foregoing relationship may be apparently established by unifying polarities, facing pin installation portions 150 or pin receivers 160, of magnets provided in the modules.

A magnet installation portion 120 configured to receive the magnet 140 is provided in the frame 100. The magnet installation portion 120 may be provided to fix a position of the magnet 140. The magnet installation portion 120 may be provided in the frame 100 to be recessed in a form of a recess. As described above, the magnet 140 is disposed between the pin receiver 160 and the pin installation portion 150. Further, the magnet installation portion 120 may be provided such that the magnet 140 may not be exposed outside the first module 10. However, the foregoing is merely an example, and the scope of example embodiments is not limited thereto. For example, the magnet installation portion 120 may be connected with the pin receiver 160 to form a single communicating space. The magnet installation portion 120 may include a structure such as a stopper to maintain the position of the magnet 140.

In addition, in the example embodiment, the magnet 140 may be a permanent magnet or an electromagnet. In a case in which the magnet 140 is an electromagnet, a power supplier such as a battery may be provided in the first module 10 to supply current to the electromagnet. In another example, the magnet 140 being an electromagnet may be provided to operate by receiving current from another module when the terminal 107 is connected to a terminal of the other module.

In the example embodiment, an example in which all of the aforementioned components are received in the lower case 11*b* is described. However, the foregoing is merely an example, and the scope of example embodiments is not limited thereto. For example, the pin installation portion 150, the pin receiver 160, and the magnet installation portion 120 may have complete forms when the upper case 11*a* is coupled to the lower case 11*b*. The pin 180 and the magnet 140 may be disposed in both the upper case 11*a* and the lower case 11*b*. In another example, a portion or all of the aforementioned components may be installed in the upper case 11*a*.

Meanwhile, the other modules, in detail, the second module 20, the third module 30, and the fourth module 40 may be the same or correspond to the first module 10 in terms of structural characteristics. For example, in a case in which the first module 10 has a structure as shown in FIGS. 1 and 2, the remaining modules 20, 30, and 40 may have the same structures. Hereinafter, an example in which the second module 20, the third module 30, and the fourth module 40 have configurations substantially the same as that of the first module 10 in terms of a coupling manner will be described. In this example, all the modules may be formed to have the same appearances. Thus, an overall process of manufacturing the module assembly 1 may be simplified, and the modules may be easily assembled.

Hereinafter, to prevent duplicated descriptions, detailed descriptions of components of the second module 20, the third module 30, and the fourth module 40 corresponding to the components of the first module 10 will be omitted. If necessary, descriptions will be provided by changing the first digits of the reference numerals thereof to "2", "3", and "4", respectively. For example, a pin of the second module 20 corresponding to the pin 180 of the first module 10 may be assigned a reference numeral 280. In detail, the second module 20 may include a frame 200, a substrate 202, a processor 204, a conducting wire 206, a terminal 207, the pin 280, a pin installation portion 250, a pin receiver 260, a magnet installation portion 220, and a magnet 240.

Hereinafter, a process of coupling the first module 10 and the second module 20 will be described with reference to the drawings.

Figure 4:
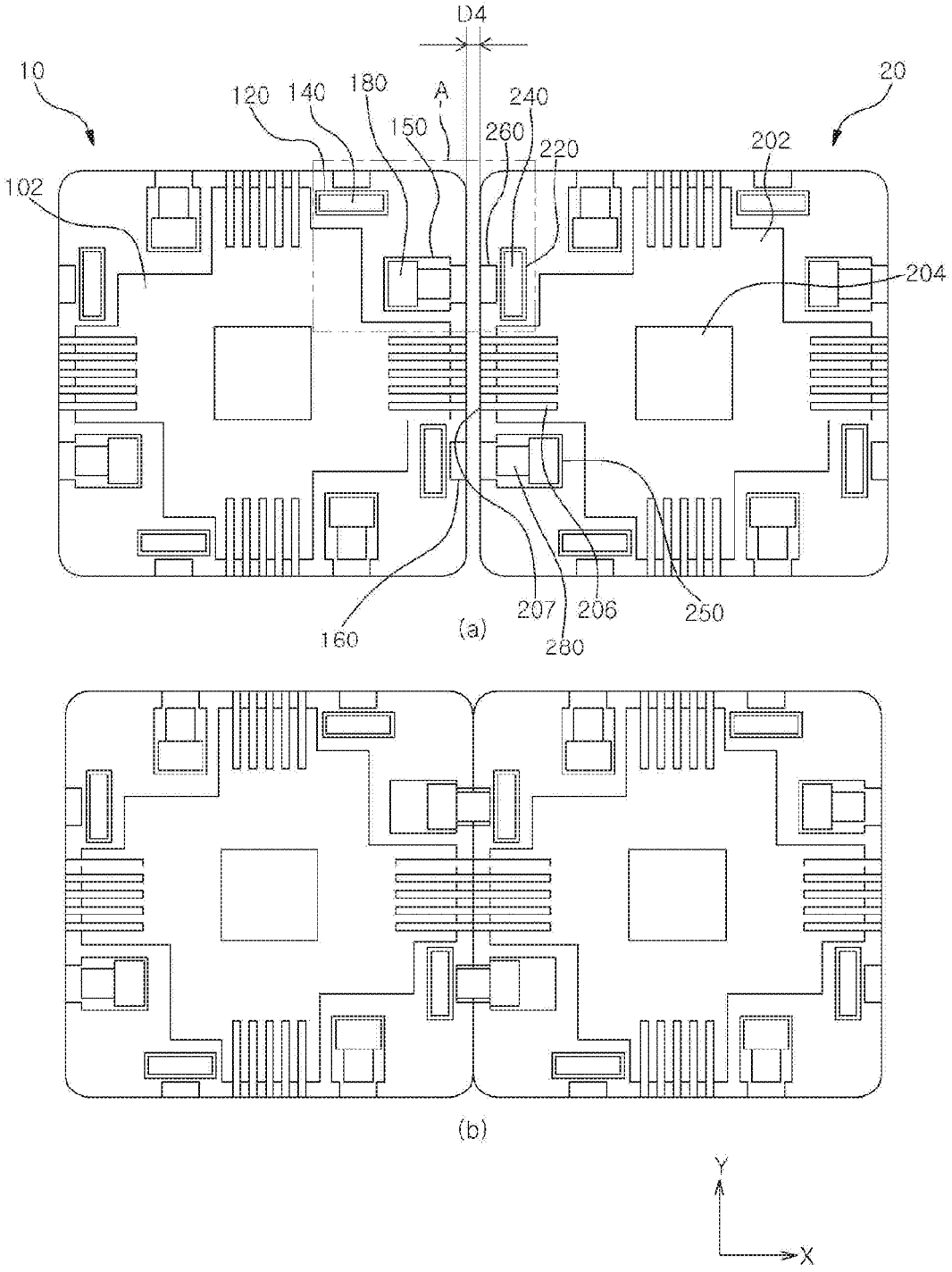
FIG. 4 illustrates a process of coupling the first module and a second module of FIG. 1.
Figure 5:
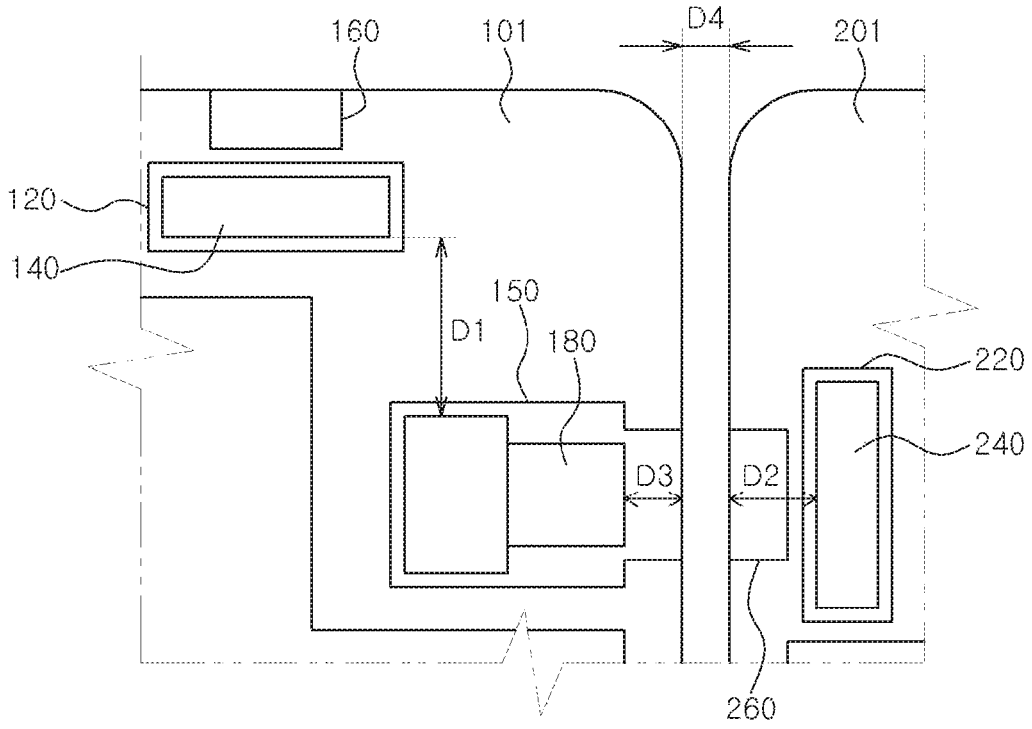
FIG. 5 is an enlarged view illustrating a portion A of FIG. 4.

FIG. 4 illustrates a process of coupling the first module and the second module of FIG. 1, and FIG. 5 is an enlarged view illustrating a portion A of FIG. 4.

Referring to (a) of FIG. 4, the first module 10 and the second module 20 may be coupled to each other in an X-axial direction. In a case in which the first module 10 and the second module 20 are disposed alongside in a Y-axial direction, the first module 10 and the second module 20 may also be coupled to each other.

Here, an example in which the first module 10 and the second module 20 are aligned in the Y-axial direction will be described. In this example, the pin 180 of the first module 10 and the pin receiver 260 of the second module 20 may face each other. Hereinafter, for ease of description, among the magnets shown in the drawings, the magnet 140 provided in the first module 10 will be referred to as the first magnet 140, and the magnet 240 of the second module 20 may will be referred to as the second magnet 240.

Here, a magnitude of magnetic force applied by the first magnet 140 to the pin 180 may be inversely proportional to a square of a distance D1 between the first magnet 140 and the pin 180, and may change based on a position of the pin 180 in the pin installation 150. Further, a magnitude of magnet force applied by the second magnet 240 to the pin 180 may be inversely proportional to a square of a distance between the second magnet 240 and the pin 180. Here, the distance between the second magnet 240 and the pin 180 may correspond to a sum of a distance D2 from the second magnet 240 to a side of the second module 20, a distance D3 from a side of the first module 10 to an end portion of the pin 180, and a distance D4 between the first module 10 and the second module 20, and may change based on the distance D4.

As described above, the magnetic force of the first magnet 140 on a corner 101 on which the pin 180 of the first module 10 is provided and the magnetic force of the second magnet 240 on a corner 201 on which the pin receiver 260 of the second module 20 is provided may be applied simultaneously to the pin 180 to couple the first module 10 and the second module 20. Here, in a case in which a basic magnitude of the magnetic force of the first magnet 140 is equal to a basic magnitude of the magnetic force of the second magnet 240, a magnitude of force to be applied to the pin 180 may change based on a relationship between the distance D1 and the sum of the distances D2, D3, and D4.

First, in a case in which a distance between the first module 10 and the second module 20 is relatively great and a relationship of D1<(D2+D3+D4) is established, the magnitude of the magnetic force applied by the second magnet 240 to the pin 180 may be less than the magnitude of the magnetic force applied by the first magnet 140 to the pin 180. Thus, the pin 180 is maintained in the second state in which the pin 180 is received in the first module 10.

In a case in which the distance between the first module 10 and the second module 20 decreases and a relationship of D1>(D2+D3+D4) is established, the magnitude of the magnetic force applied by the second magnet 240 to the pin 180 may be greater than the magnitude of the magnetic force applied by the first magnet 140 to the pin 180. Thus, the pin 180 protrudes along the pin installation portion 150 toward an outside of the first module 10. Since the distance D1 gradually increases and the magnitude of the magnetic force applied by the first magnet 140 to the pin 180 gradually decreases as the pin 180 protrudes, the pin 180 may definitely protrude toward the outside of the first module 10.

Thus, the pin 180 of the first module 10 may be inserted into the pin receiver 260 of the second module 20.

In this example, the head 182 of the pin 180 of the first module 10 may be hung on a stopper 156 of the pin installation portion 150, and the pin 180 may be attracted toward the second magnet 240, whereby the frame 100 of the first module 10, in detail, the entire first module 10 may be moved toward the second module 20.

The foregoing operation may apply identically to a pin on the other of the facing sides of the first module 10 and the second module 20. In detail, the pin 280 of the second module 20 may be inserted into the pin receiver 160 of the first module 10.

The lower drawing (b) of FIG. 4 illustrates a complete coupling state between the first module 10 and the second module 20. In this example, the first module 10 and the second module 20 may be in surface contact with each other. The pin 180 of the first module 10 and the pin 280 of the second module 20 may be in the first state in which the pin 180 and the pin 280 protrude to an outside, and be inserted into the pin receiver 260 and the pin receiver 160, respectively.

In this example, the terminal 107 of the first module 10 and the terminal 207 of the second module 20 may be in contact with each other, thereby exchanging electric signals with each other.

The coupling state between the first module 10 and the second module 20, in detail, the coupling state in an X-axial direction may be maintained by magnetic force applied by the magnet 240 or 140 provided in one module 20 or 10 to the pin 180 or 280 provided on the other module 10 or 20. Here, to maintain the coupling state, a minimum value of the distance D1, in detail, a distance between the pin 180 and the first magnet 140 when the pin 180 is completely received in the pin receiver 150 needs to be greater than a sum of the distances D2 and D3. In detail, when the first module 10 is coupled to the second module 20, stronger magnetic force of the second magnet 240 needs to be applied to the pin 180.

In addition, the coupling states between the first module 10 and the second module 20 in a Y-axial direction and a Z-axial direction, for example, a direction vertical to the ground, may be firmly maintained by the pin 280 of the second module 20.

Meanwhile, the first module 10 and the second module 20 may be smoothly coupled to each other even in a misaligned state, for example, in a state in which the first module 10 and the second module 20 tilt with respect to each other, or in a state in which the first module 10 and the second module 20 are spaced apart from each other in a Y-axial direction. In detail, since a magnitude of magnetic force of a magnet is maximized at a center of the magnet, the pin 180 of the first module 10 may be attracted toward the center of the second magnet 240, in detail, substantially toward the pin receiver 260 of the second module 20

A magnitude of magnetic force applied by the second magnet 240 may increase as the distance between the two modules 10 and 20 decreases, and a projection of the pin 180 of the first module 10 may fit in the pin receiver 260 of the second module 20. Accordingly, the pin 280 provided on the same side of the second module 20 may be induced toward the pin receiver 160 of the first module 10, and ultimately fit in the pin receiver 160 of the first module 10. In this process, the pin 180 of the first module 10 first induced toward the second module 20 may act as a center of rotation of the first module 10, or may slide along a side of the second module 20. To achieve the foregoing operation smoothly, the projection of the pin 180 of the first module 10 may have a rounded end portion.

In the same manner, the third module 30 and the fourth module 40 may also be coupled to the first module 10 or the second module 20.

Meanwhile, a separation between the first module 10 and the second module 20 may be performed in a reverse order of the foregoing process. When a user decouples the second module 20 from the first module 10 such that the relationship of D1<(D2+D3+D4) is established, the magnitude of the magnetic force applied by the first magnet 140 to the pin 180 may be greater than the magnitude of the magnetic force applied by the second magnet 240 to the pin 180. Thus, the pin 180 may be moved back toward the first magnet 140 of the first module 10, and be in the second state in which the pin 180 is received in the first module 10.

Here, the first magnet 140 and the second magnet 240 may maintain the pin 180 to be in the first state or the second state, and thus may also be referred to as a pin operator. In detail, the pin operator may include the first magnet 140 and the second magnet 240 provided at the corners 101 and 201 of the first module 10 and the second module 20 to be surface-to-surface coupled to each other, and configured to attract the pin 180 toward the first magnet 140 and the second magnet 240, respectively.

Figure 6:
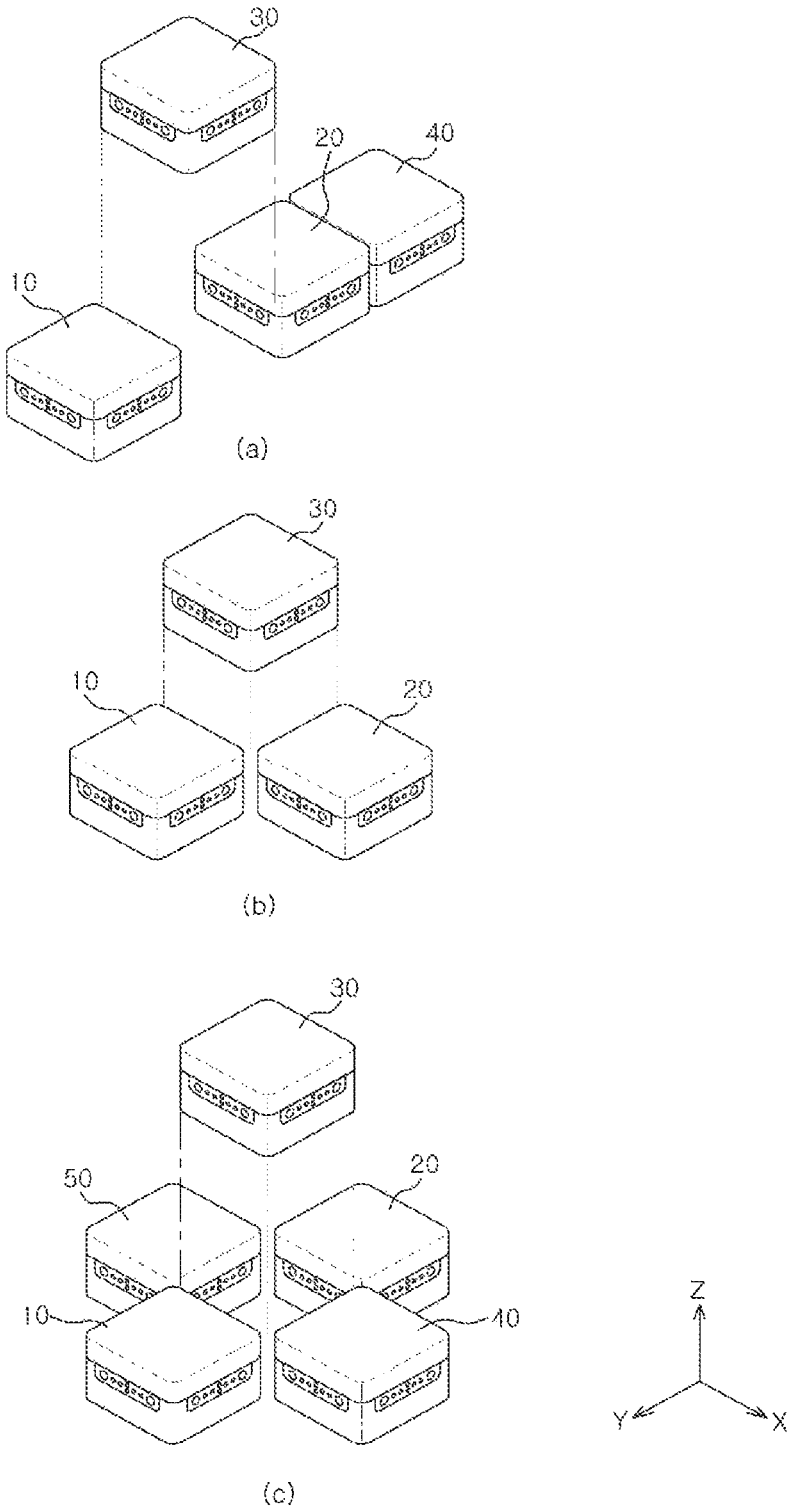
FIG. 6 illustrates a process of coupling at least three modules in a module assembly according to an example embodiment.

FIG. 6 illustrates a process of coupling at least three modules in a module assembly according to an example embodiment.

In the related arts, a coupling protrusion protrudes outside a module at all times. Thus, in situations as shown in (a) and (b) of FIG. 6, the third module 30 may not be coupled to the first module 10 and the second module 20. The third module 30 may need to be coupled to the first module 10 or the second module 20 first, and other modules may be sequentially coupled thereto. Further, in a situation as shown in (c) of FIG. 6, to couple the third module 30, other modules 10, 20, 40, and 50 may need to be separated from each other, and coupled to the third module 30 one at a time.

In contrast, one module 30 according to an example embodiment may be assembled with other modules irrespective of a coupling order. Further, one module 30 may be assembled in a direction in which a pin of the one module 30 is inserted into a pin receiver of another module, in detail, an X-axial or Y-axial direction, and also in a direction perpendicular thereto, for example, a Z-axial direction. In addition, one module 30 may be assembled into a space between two modules 10 and 20 being spaced apart from each other, irrespective of a direction.

First, as shown in (a) of FIG. 6, the third module 30 may be assembled in a state in which the second module 20 and the fourth module 40 are already assembled, and the first module 10 is spaced apart from the second module 20. In detail, in a case in which the modules are to be arranged in an "I"-shaped form, a module assembly may be assembled by adding a new module between the modules. In this example, the third module 30 may be coupled to the first module 10 and the second module 20 simultaneously.

In detail, the third module 30 may fit in the space between the first module 10 and the second module 20 while being in surface contact with the first module 10 and the second module 20 simultaneously. In the drawing, an example in which the third module 30 fits in the Z-axial direction is provided. However, the third module 30 may also fit in the X-axial or Y-axial direction. When the third module 30 is disposed at a regular position, pins may protrude from one of the first module 10 and the second module 20 and be inserted into the third module 30, and pins may protrude from the third module 30 and be inserted into the other of the first module 10 and the second module 20. In doing so, the third module 30 may be firmly fastened to the first module 10 and the second module 20.

Further, as shown in (b) of FIG. 6, the third module 30 may be assembled with the first module 10 and the second module 20 simultaneously in a state in which the first module 10 and the second module 20 are disposed in a diagonal direction. Similar to the case of (a) of FIG. 6, the third module 30 may enter the space between the first module 10 and the second module in a predetermined direction, and be coupled to the first module 10 and the second module 20 simultaneously while being in surface contact therewith. In detail, in a case in which modules are to be arranged in an "L"-shaped form, a module assembly may be assembled by adding a new module at an intermediate position therebetween.

In addition, as shown in (c) of FIG. 6, the third module 30 may be assembled by fitting in a space surrounded by the other modules 10, 20, 40, and 50. In this example, the third module 30 may fit in the space among the modules 10, 20, 40, and 50 in the Z-axial direction. In an example, when the third module 30 fits in to be disposed at a regular position, pins may protrude from the first module 10 and the fourth module 40 and be inserted into the third module 30, and pins may protrude from the third module 30 and be inserted into the second module 20 and the fifth module 50. In detail, in a case in which modules are to be arranged in a cross-shaped form, a model assembly may be assembled by adding a new module at an intermediate position thereamong.

Hereinafter, effects of the module assembly 1 according to an example embodiment will be described based on a coupling relationship between the first module 10 and the second module 20.

The module assembly 1 as described above may have effects as follows.

A user may assemble the modules 10, 20, 30, and 40 simply by disposing the modules 10, 20, 30, and 40 within a preset distance, thereby assembling the module assembly 1 conveniently.

Further, the first module 10 and the second module 20 may have a first state in which the pins 180 and 280 protrude from the modules 10 and 20, and a second state in which the pins 180 and 280 are received in the modules 10 and 20, respectively. The pins 180 and 280 may be in the second state in which the pins 180 and 280 are received in the modules 10 and 20 in a case in which the modules 10 and 20 are not coupled to each other, and in a case in which a distance between the modules 10 and 20 is greater than a preset distance. Thus, the pins may not be damaged by impact applied while the modules are not assembled.

In addition, the first module 10 and the second module 20 may be easily coupled to each other in a state in which the pins 180 and 280 are not completely aligned with the pin receivers 160 and 260. Magnetic forces applied by the magnets 140 and 240 to outsides of the modules 10 and 20 through the pin receivers 160 and 260 may be applied directly to the pins 180 and 280 exposed to side end portions of the modules 10 and 20. Thus, the pins 180 and 280 may be easily attracted, and naturally induced into the pin receivers 160 and 260 by the magnetic forces, whereby the first module 10 and the second module 20 may be automatically aligned and coupled to each other.

Further, both the magnets 140 and 240 provided in the modules 10 and 20 may be disposed in the frames 100 and 200, and may not be exposed to an outside. Thus, the magnets 140 and 240 may not be damaged by external impact or friction.

In addition, one module 30 may be coupled to the other modules irrespective of a coupling order and a coupling direction. The foregoing effect may be achieved in the manner in which pins provided in a module are maintained in the first state while being unassembled and protrude to be in the second state only when modules are in surface contact with each other. In particular, in a case in which the modules are formed in the shapes, the assembly convenience of the modules may be maximized.

Further, the module assembly 1 may be assembled in a simple structure by means of the magnets and the pins provided in the modules 10, 20, 30, and 40, and thus the sizes of the modules 10, 20, 30, and 40 may be minimized.

In particular, in the example embodiment, a single magnet 140 performs two operations, in detail, one operation of applying magnetic force to a pin received in the pin installation portion 150 disposed adjacent thereto, and the other operation of applying magnetic force to a pin of another module to be received in the pin receiver 160. Thus, a single magnet disposed at each corner 101 may be used to couple a plurality of modules to each other. In detail, a number of magnets to be needed for a single module may be reduced and a module assembly may be simply structured, whereby the productivity of the module assembly may improve.

Hereinafter, a module assembly according to another example embodiment will be described with reference to FIGS. 7 through 9. However, the example embodiment of FIGS. 7 through 9 differs from the example embodiment of FIG. 2 in that modules are assembled on a plate. Thus, the example embodiment of FIGS. 7 through 9 will be described based on such differences, and the same descriptions and reference numerals of FIG. 2 will be applied to the same components.

Figure 7:
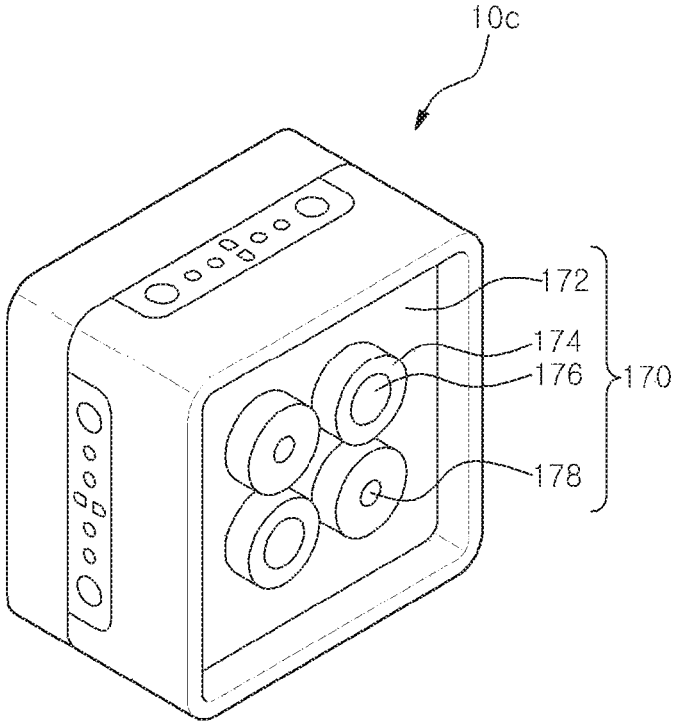
FIG. 7 is a perspective view illustrating a bottom of a module assembly according to another example embodiment.
Figure 8:
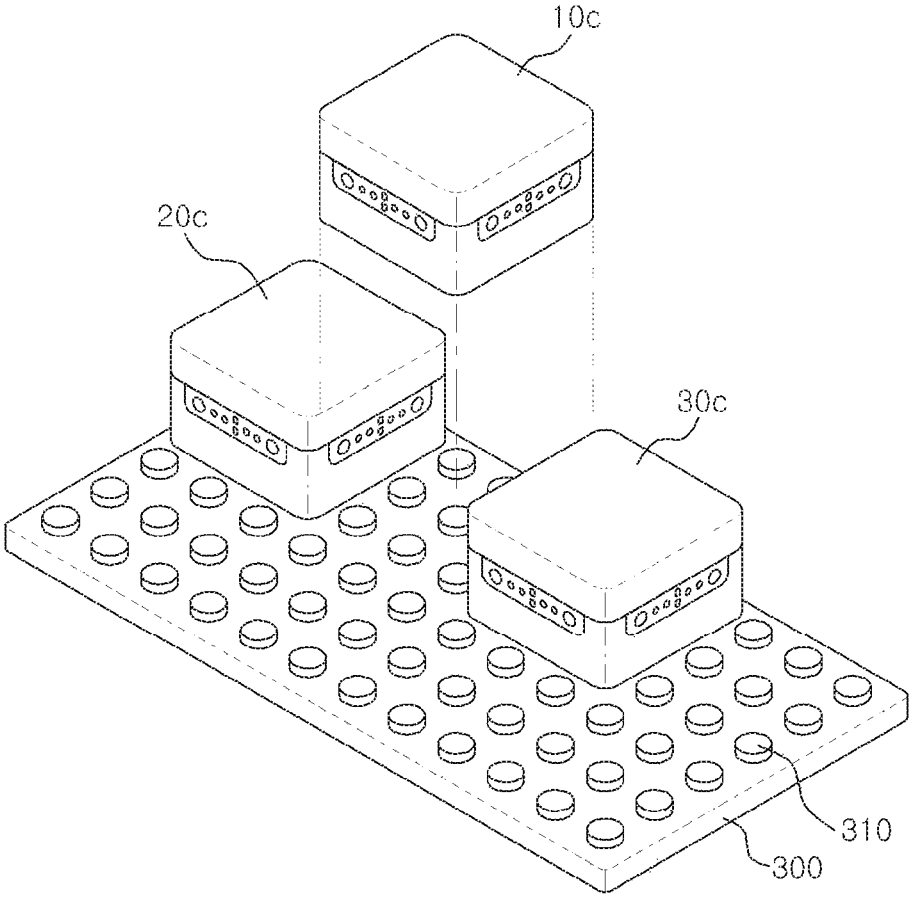
FIG. 8 illustrates modules of FIG. 7 being assembled on a plate.
Figure 9:
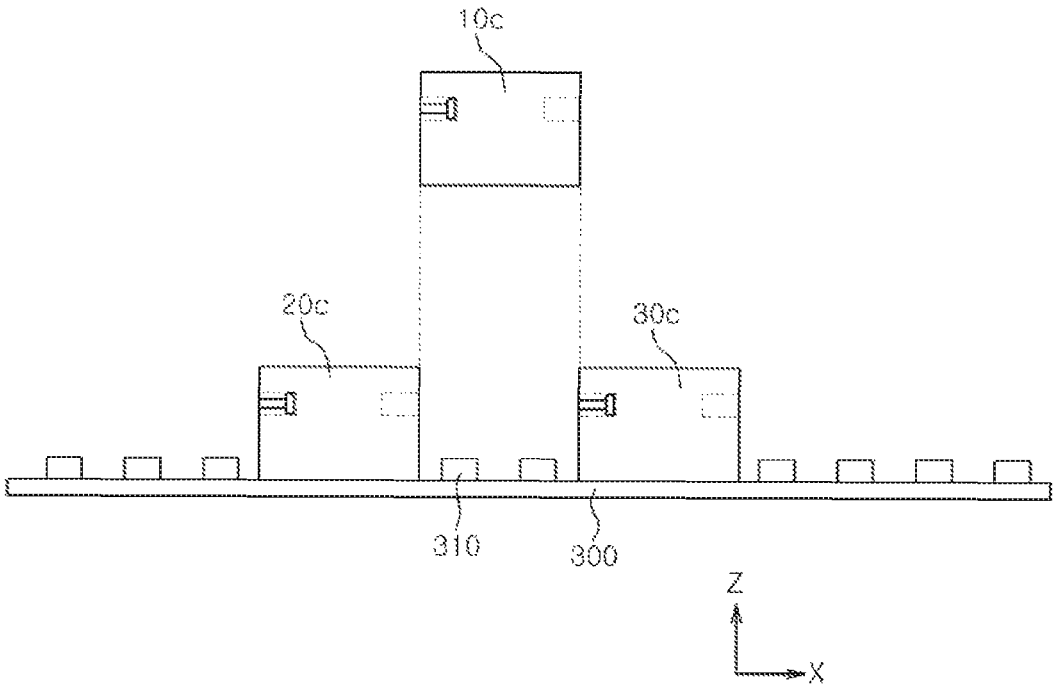
FIG. 9 illustrates modules of FIG. 7 being assembled on a plate.

FIG. 7 is a perspective view illustrating a bottom of a module assembly according to yet another example embodiment, and FIGS. 8 and 9 illustrate modules of FIG. 7 being assembled on a plate.

Referring to FIGS. 7 through 9, a module assembly according to yet another example embodiment may be coupled to a plate 300 including a plurality of protrusions 310. A fit-coupling portion 170 may be formed on a bottom of a first module 10*c* to be coupled to the plate 300.

The protrusions 310 of the plate 300 may have cylindrical shapes extending at predetermined heights, and disposed at preset intervals in a matrix structure. The plate 300 may have the same shape as a module which is known as LEGO. The protrusions 310 may protrude in a direction perpendicular to the plate 300.

The fit-coupling portion 170 formed on the bottom of the first module 10*c* may include insertion recesses 172 into which one or more protrusions 310 may be inserted. The fit-coupling portion 170 may further include protrusions 174 in which bolt fastening holes 178 or magnets 176 may be provided to firmly fasten the first module 10*c*. The shapes and intervals of the protrusions 174 may correspond to those of the protrusions 310 of the plate 300 such that the protrusions 310 of the plate 300 may firmly fit in the insertion recesses 172 of the first module 10*c*. Here, the bolt fastening holes 178 and the magnets 176 may be used to additionally fasten the first module 10*c* to the plate 300. In addition, the bolt fastening holes 178 and the magnets 176 may be used to fasten the first module 10*c* to a predetermined location at which the first module 10*c* may be attached, for example, a wall.

Further, similar to the first module 10*c*, other modules 20*c* and 30*c* may each include a fit-coupling portion 170.

The modules 10*c*, 20*c*, and 30*c* formed as described above may need to be coupled to the plate 300 in a direction in which the protrusions 310 protrude, in detail, in a direction perpendicular to the plate 300. However, in the related arts, protrusions provided to couple modules protrude to an outside all the time. Although the modules may have configurations corresponding to the fit-coupling portion, the modules may not be sequentially coupled to the plate 300 since the protrusions may interfere in assembling. Thus, in the related arts, to assemble the modules on the plate 300, the modules need to be assembled first and the entire assembly needs to be coupled to the plate 300, or the modules need to be assembled by forcedly fitting the modules on the plate 300 using a predetermined level of external force.

However, in the module assembly according to the example embodiment, the first module 10*c* may be coupled to the plate 300 and the other modules 20*c* and 30*c* simultaneously while the other modules 20*c* and 30*c* are already assembled on the plate 300, as shown in FIGS. 8 and 9.

In detail, the first module 10*c* may fit in a space between the second module 20*c* and the third module 30*c* while being in surface contact with the second module 20*c* and the third module 30*c* simultaneously. In this example, a direction in which the first module 10*c* fits in is the same as a direction in which the protrusions 310 protrude, and a direction in which the first module 10*c* is to be coupled to the plate 300. When the first module 10*c* fits on the protrusions 310 of the plate 300, the first module 10*c* may be in surface contact with the second module 20*c* and the third module 30*c*, pins may protrude from each of the modules 10*c*, 20*c*, and 30*c* such that the modules 10*c*, 20*c*, and 30*c* may be coupled to one another. Thus, the first module 10*c* may be firmly fastened to the second module 20*c* and the third module 30*c*.

The module assembly according to example embodiments is described in detail above. However, the example embodiments are not limited thereto, and should be construed broadly within its spirit and scope disclosed herein. It will be apparent to those skilled in the art that the example embodiments can be combined and/or replaced to achieve alternative example embodiments not explicitly described herein, without departing from the spirit or scope of the present disclosure. In addition, various alterations and modifications may be made to the example embodiments disclosed herein, and should be construed as being covered within the scope of the following claims.

What is claimed is:

1. A module assembly comprising a plurality of modules, wherein the plurality of modules comprises a first module and a second module, and each of the first module and the second module comprises:

a polyhedral housing with a polygonal plane;

a pin provided on one side of a corner of the housing to selectively protrude;

a pin installation portion in which the pin is installed to be movable between a first position and a second position;

a pin receiver provided on another side of the corner of the housing such that a pin of another module is to be inserted thereinto; and a magnet installed between the pin installation portion and the pin receiver, wherein the pin moves between the first position and the second position based on a difference between magnetic force applied by the magnet to the pin and magnetic force applied by a magnet of other module to the pin, and the pin of the first module is in the first position if the magnetic force applied by the magnet of the first module to the pin of the first module is greater than the magnetic force applied by the magnet of the second module to the pin of the first module.

2. The module assembly of claim 1, wherein the pin installation portion and the pin receiver are formed on both sides of each corner of the housing.

3. The module assembly of claim 2, wherein the housing has a regular polygonal plane.

4. The module assembly of claim 1, wherein a distance from the corner to the pin corresponds to a distance from the corner to the pin receiver.

5. The module assembly of claim 1, wherein a terminal is provided on a side of the housing to exchange at least one of electrical energy, electric signals, and data with another module.

6. The module assembly of claim 1, wherein the pin adjacent to a first magnet of the first module is configured to be inserted into the pin receiver adjacent to a second magnet of the second module, and the magnet of the first module is disposed such that a distance D1 from the first magnet to the pin of the first module is less than a sum of a distance D2 from the second magnet to a side of the second module and a distance D3 from a side of the first module to the pin of the first module when the pin of the first module is received in the pin installation portion of the first module.

7. The module assembly of claim 1, wherein the pin comprises a head and a projection protruding from the head, and the pin installation portion comprises a head guide configured to provide a space in which the head is movable and to guide a movement of the head, a projection guide configured to provide a space in which the projection is movable and to guide a movement of the projection, and a stopper provided between the head guide and the projection guide to prevent the head from being separated toward an outside of the housing.

8. A module comprising:

a polyhedral housing with a polygonal plane;

a pin provided on one side of a corner of the housing;

a pin installation portion in which the pin is movable between a first position and a second position;

a pin receiver provided on another side of the corner of the housing such that a pin of other module is to be inserted thereinto; and a first magnet installed between the pin installation portion and the pin receiver, wherein the pin moves between the first position and the second position based on magnetic force applied by the first magnet of the module to the pin and magnetic force applied by a second magnet of the other module to the pin, and wherein the pin is in the first position if the magnetic force applied by the first magnet of the module to the pin is greater than the magnetic force applied by the second magnet of the other module to the pin.

9. The module of claim 8, wherein the first magnet is disposed in the module such that a distance D1 from the first magnet of the module to the pin of the module is to be less than a sum of a distance D2 from the second magnet of the other module to a side of the other module and a distance D3 from a side of the other module to the pin of the module when the pin of the module is in the first position.

10. The module of claim 8, wherein when the pin is in the first position, an entire of the pin is within the pin installation portion.

11. The module of claim 8, wherein when the pin is in the second position, a part of the pin protrudes outside the pin installation portion.

12. The module of claim 8, wherein the pin is in the second position if the magnetic force applied by the first magnet of the module to the pin is less than the magnetic force applied by the second magnet of the other module to the pin.

13. A module assembly comprising:

a first module and a second module disposed to be spaced apart from each other; and a third module to be coupled to the first module and the second module while being in surface contact therewith, wherein, each of the first module, the second module, and the third module comprises:

a pin installation portion inside the each of the first module, the second module, and the third module;

a pin movable in the pin installation portion, the pin being either in a first position where an entire of the pin is within the pin installation portion or in a second position where a part of the pin protrudes outside the pin installation portion based on magnetic force applied to the pin; and a magnet configured to apply the magnetic force, wherein the pin provided in one of the first module, the second module, and the third module moves from the first position to the second position if the magnetic force applied by the magnet provided in the one of the first module, the second module, and the third module to the pin becomes less than the magnetic force applied by the magnet of another of the first module, the second module, and the third module to the pin, wherein the third module is coupled to the first module when a pin provided in one of the first module and the third module protrudes and fits in a pin receiver provided in the other of the first module and the third module, the third module is coupled to the second module when a pin provided in one of the second module and the third module protrudes and fits in a pin receiver provided in the other of the second module and the third module, and the pins are configured to protrude when the third module fits in between the first module and the second module.

14. The module assembly of claim 13, wherein the pins are in the first position when the third module is not in surface contact between the first module and the second module.

15. The module assembly of claim 13, wherein the first module, the second module, and the third module each have a side to be in surface contact with an adjacent module and a regular polygonal plane.

16. The module assembly of claim 15, wherein the pin of each of the first module and the second module is provided on one side of a corner on the plane, and the pin receiver of each of the first module and the second module is provided on another side of the corner on the plane.

17. The module assembly of claim 13, wherein the first module, the second module, and the third module are coupled to each other in an "I"-shaped or "L"-shaped form.

18. The module assembly of claim 13, further comprising:

a fourth module to be coupled to the third module, wherein the fourth module is coupled to the third module when a pin provided in one of the third module and the fourth module to selectively protrude fits in a pin receiver provided in the other of the third module and the fourth module, and the pin is configured to protrude when the fourth module is in surface contact with the third module.

19. The module assembly of claim 13, further comprising:

a plate to which the first module, the second module, and the third module are to be coupled, wherein the first module and the second module are coupled to the plate in advance, and the third module is coupled to the plate by fitting in a space between the first module and the second module.

* * * * *